United States Patent [19]

Palz et al.

[11] Patent Number: 4,612,981

[45] Date of Patent: Sep. 23, 1986

[54] CERAMIC RECUPERATOR TUBE AND A RECUPERATOR EMPLOYING PLURAL SUCH TUBES

[75] Inventors: Helmut Palz; Hartmut Kainer, both of Wiesbaden, Fed. Rep. of Germany

[73] Assignee: Didier-Werke AG, Wiesbaden, Fed. Rep. of Germany

[21] Appl. No.: 648,278

[22] Filed: Sep. 7, 1984

[30] Foreign Application Priority Data

Sep. 19, 1983 [DE] Fed. Rep. of Germany ..... 3333764

[51] Int. Cl.[4] ..... F28F 9/02

[52] U.S. Cl. ..... 165/158

[58] Field of Search ..... 165/157, 158, 165

[56] References Cited

U.S. PATENT DOCUMENTS

| | | | |
|---|---|---|---|
| 1,426,381 | 8/1922 | Hecker | 165/165 |
| 1,745,978 | 2/1930 | Cahill | 165/157 X |
| 1,771,160 | 7/1930 | Chapman | 165/165 |
| 2,733,908 | 2/1956 | Graham | 165/158 X |
| 2,764,398 | 9/1956 | Herman | 165/119 |
| 3,135,503 | 6/1964 | Sommerer et al. | 165/158 |

FOREIGN PATENT DOCUMENTS

| | | | |
|---|---|---|---|
| 880677 | 6/1953 | Fed. Rep. of Germany | 165/157 |
| 1069336 | 11/1957 | Fed. Rep. of Germany | 165/157 |
| 679163 | 4/1930 | France | 165/165 |
| 725332 | 5/1932 | France | 165/165 |
| 400720 | 11/1933 | United Kingdom | 165/157 |

*Primary Examiner*—Albert W. Davis, Jr.
*Assistant Examiner*—Peggy Neils
*Attorney, Agent, or Firm*—Wenderoth, Lind & Ponack

[57] ABSTRACT

A recuperator includes plural ceramic recuperator tubes arranged vertically on top of each other. Each tube has an outer periphery, first and second opposite ends, and a gas passage extending longitudinally between such ends. The first end includes an annular sealing surface extending radially inwardly from the periphery and an annular projection defined by a conical surface extending axially from the sealing surface to an end surface of the first end. The second end includes a square flange extending outwardly from the periphery and a stepped seal extending axially inwardly into the flange from an end surface of the second end.

22 Claims, 14 Drawing Figures

CERAMIC RECUPERATOR TUBE AND A RECUPERATOR EMPLOYING PLURAL SUCH TUBES

BACKGROUND OF THE INVENTION

The present invention relates to a ceramic recuperator tube and a recuperator employing plural such tubes, and particularly a recuperator of the type wherein plural ceramic recuperator tubes are arranged vertically on top of each other, each recuperator tube having an outer periphery, first and second opposite ends, and a gas passage extending longitudinally between the ends.

Such recuperators are employed to recover the waste heat from heavily contaminated exhaust or waste gases of high temperature by means of preheating air or other noncombustible gaseous media. That is, the heat from the waste gases is employed to heat air or another gas. The optimum mode of operation for recuperators of this type depends particularly on the degree of sealing of the gas carrying recuperator tubes, the mechanical strength of the recuperator tubes, the resistance of such tubes to cracking during operation, the deposit of suspended flue dust carried by the hot gases, and the chemical wear resistance of the ceramic material of the tubes.

SUMMARY OF THE INVENTION

The object of the present invention is to provide a ceramic recuperator tube and a recuperator employing plural such tubes whereby it is possible to compensate for vertical as well as horizontal expansion of the recuperator tubes during operation of the recuperator, while at the same time obtaining an optimal sealing of the assembled recuperator tubes. It is a further object of the present invention to provide such a ceramic recuperator tube and recuperator whereby the recuperator easily can be cleaned on the side of the flue gases, and whereby the flue gases are sealed, particularly at the inlet and outlet ends, against the gaseous mediums to be heated.

These objects are achieved in accordance with the present invention by the provision that each ceramic recuperator tube includes a first end having an annular sealing surface extending radially inwardly from the periphery, and an annular projection defined by a conical surface extending axially from the sealing surface to an end surface of the first end. Each recuperator tube further includes a second end having a square flange extending outwardly from the periphery, and a stepped seal extending axially inwardly into the flange from an end surface of the second end. The projection and sealing surface of the first end of one tube extend into and seal with the stepped seal of the second end of another tube. The stepped seal comprises axially outer and inner steps. The outer step includes at least one axial surface extending inwardly from the end surface of the second end and a ground or planed annular bearing surface extending radially inwardly from the axial surface. The inner step includes an annular conical sealing surface extending axial inwardly from the bearing surface and an annular sealing surface extending radially inwardly from the conical sealing surface to the gas passage. The first end of one tube extends into the second end of the other tube with the end surface of the first end facing the annular sealing surface of the second end, with the conical surface of the first end facing the conical sealing surface of the second end, with the annular sealing surface of the first end facing the bearing surface of the second end, and with the periphery of the first tube, at least the endmost portion thereof, facing the axial surface of the second end.

There may be provided a ceramic mastic or putty material between respective of the facing surfaces of the stepped seal. Such mastic or putty may be provided between all of the respective facing surfaces of the stepped seal, or alternatively the annular sealing surface of the first end may directly contact the bearing surface of the second end, the ceramic mastic or putty being provided between the other respective facing surfaces.

Preferably, the gas passage has a circular cross section and is defined by a cylindrical surface. The periphery of the tube may have a circular cross section defined by a cylindrical surface, or the periphery may have a polygonal cross section, preferably an octagonal cross section. The octagonal cross section provides the tube with an outer surface that is larger by six percent than a round cross section outer surface.

Certain of the tubes each may have formed therein a rectangular opening extending from the gas passage to the tube periphery.

The tube must be formed of a ceramic material having a good heat conductivity and which will be gas tight and resistant to chemical attack. Furthermore, the tube material must be insensitive to changes of temperature, i.e. it must not have a tendency to crack as a result of rapid temperature changes. A particular refractory material exhibiting these properties is SiC.

In accordance with the present invention, the recuperator includes vertically spaced tiers of tubes, each tier comprising parallel rows of tubes, the tubes of adjacent rows being staggered longitudinally of the rows, thereby defining gaps at the ends of alternate of the rows. Fill members, preferably having the shape of partial tubes, fill these gaps.

The tubes of the lowermost tier are mounted on a perforated plate, preferably of a material such as steel or cast iron. The square flanges of the tubes of each tier form a closed plate at the top of the tier, such plate being employed for mounting the next upper tier of tubes. The gas passages through the tubes of the lowermost tier communicate through the perforations in the metal plate.

The flue gases or waste gases flow along the upper section of the recuperator into a deflector chamber lined with refractory material. The upper tier or tiers of the bundle of tubes in the recuperator are designed such that spaces around the tubes can be filled with a refractory putty or a mastic. Similarly, the crossover area at the bottom of the bundle of tubes may be filled with a refractory putty or a mastic to protect the bottom metal plate against the effects of temperature, and to provide a supplementary seal.

The fill members in the shape of partial tubes may be defined in the longitudinal direction as half-tubes, the openings of which are filled with a refractory material. Alternatively, such fill elements may be prefabricated as solid elements.

The joints between the adjacent flange surfaces of the upper ends of the tubes of each tier may be sealed by the positioning therebetween of appropriately dimensioned felt strips.

When mounting the next tier of tubes, the empty spaces around the tubes may be filled with a refractory putty or a mastic for a height of approximately 20 to 30 mm. The seams at the points of contact of the flanges of the tubes are sealed with the above mentioned felt strips, particularly formed of a temperature resistant felt material, and being of a height of, for example, 56 mm. The felt strips are bonded on one side and are compressed during installation to a thickness of approximately 2 mm. In this way, the horizontal expansion of the flanges of the tubes is compensated or taken into account. The vertical elongation or expansion of the tubes of the bundle of tubes in the recuperator takes place from an insulated steel plate towards the top into a soft end packing of heat resistant fiber material which may be retained or maintained in place by refractory bricks. The sealing areas thus provided are designed in such a manner that the bundle of tubes can move freely from the bottom to the top, to accommodate vertical expansion of the tubes, into a soft sealing rim formed of a heat resistant fibrous material. Horizontal expansion of the flanges of the tubes is absorbed or accommodated by the felt inserts.

Preferably, the recuperator includes a bundle of tubes arranged in tiers provided in a casing having inlet and outlet openings for circulating through the casing exteriorly of the tubes a gas to be heated. Flue gas inlet and outlet hoods are connected to the casing for supplying flue gas into the gas passages of the bundle of tubes and for discharging the flue gas therefrom. Thus, the casing may be covered at the top with a removable flue gas inlet hood and may be shut off at the bottom of the tubes by a flue gas discharging hood and/or collecting chamber. The recuperator casing may have a rectangular shape. In the event that the height of a given space or room will not accommodate a vertically arranged recuperator, then the recuperator may be divided into two equal parts which are placed side-by-side adjacent one another. In such divided recuperator, the same basic design features apply for each individual recuperator part. However, in the less hot portion of the recuperator, the entry side and delivery sides are reversed. With respect to the temperature load and the demand for gas density, the reversal of direction of flow of the less hot part does not present a problem.

The inlet and outlet openings of the heat delivering and the heat absorbing gaseous mediums are selected such that a countercurrent flow of the two gases is provided. However, the openings may be arranged such that either a cross or counterflow or merely a crossflow is provided.

The flue or waste gases pass through the gas passages in the tubes. The assembled tubes define smooth walled circular gas passages that easily can be cleared of deposits with appropriate tools. To clean the bundle of tubes, the recuperator is provided with a removable flue gas inlet hood at the top and a collecting or cleaning chamber at the bottom. The gas passages of the tubes open at the bottom into the cleaning or collecting chamber.

In accordance with the structural arrangement of the present invention, there is provided a recuperator including a plurality of recuperator tubes which are allowed to move freely without interference, both horizontally and vertically, to compensate for thermal expansion. Furthermore, there is achieved an optimum sealing of the assembled tubes. The recuperator easily can be cleaned on the side of the spent gases. Furthermore, there is achieved an optimum sealing between the portions of the recuperator accommodating the heating waste gas and the heated gaseous medium, for example air. This is achieved particularly at the entrance and exit sides of the passage of the flue gasses through the recuperator.

BRIEF DESCRIPTION OF THE DRAWINGS

The above and other objects, features and advantages of the present invention will be described in more detail below, with reference to the accompanying drawings, wherein.

DETAILED DESCRIPTION OF THE INVENTION

Figure 1A:
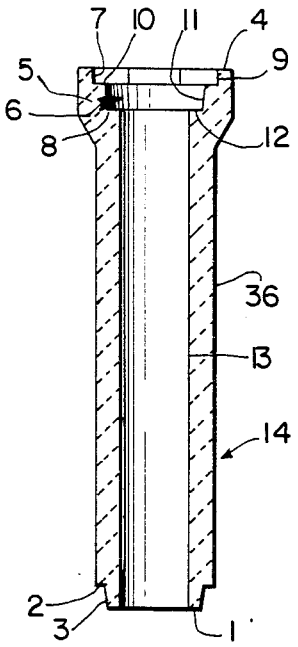
FIGS. 1A, 1B and 1C, respectively, are a longitudinal cross sectional view, a top plan view and a bottom plan view of a ceramic recuperator tube in accordance with the present invention.
Figure 1B:
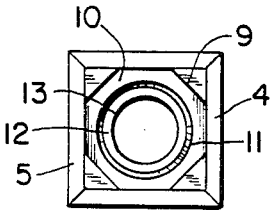
Figure 1C:
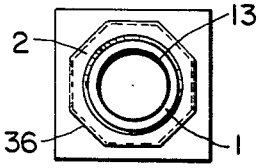

FIGS. 1A–1C illustrate a ceramic recuperator tube according to the present invention. The tube 14 includes an outer periphery 36 which may be of circular cross section or polygonal cross section. In the illustrated arrangement, periphery 36 is of octagonal cross section, since such cross sectional configuration provides an outer surface area six percent greater than a circular cross sectional outer surface. The tube has therethrough a longitudinal gas passage 13 defined by a cylindrical surface, thereby providing a circular cross section. A first end, i.e. the lower end shown in FIG. 1A, of tube 14 includes an annular sealing surface 2 extending radially inwardly from periphery 36, and an annular projection 3 defined by a conical surface extending axially from sealing surface 2 to end surface 1 of the first end. The second end of tube 14, i.e. the upper end shown in FIG. 1A, includes a square flange 5 extending outwardly from periphery 36, and a stepped seal 6 extending axially inwardly into flange 5 from an end surface 4 of the second end. As will be apparent from a consideration of FIG. 2, the structure of the opposite ends of each recuperator tube is such that two tubes 14, 16 may be nested together in a sealed manner whereby the sealing surface 2 of the first end of tube 14 extends into and seals with the stepped seal 6 of the second end of tube 16.

Figure 2:
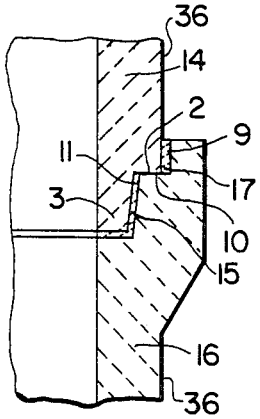
FIG. 2 is an enlarged cross sectional view illustrating the manner of joining of two tubes of the construction of FIGS. 1A–1C.

In accordance with the preferred arrangement illustrated in the drawings, the stepped seal 6 comprises axially outer and inner steps 7, 8, respectively. Outer step 7 includes at least one axial surface 9 extending inwardly from the end surface 4 of the second tube end and a ground annular bearing surface 10 extending radially inwardly from axial surface 9. In the illustrated arrangement, there are provided eight axial surfaces 9 to accommodate the eight outer surfaces of the periphery 36. However, axial surface 9 could include a single cylindrical surface or other configurations of surfaces as will be apparent to those skilled in the art. The inner step 8 comprises an annular conical sealing surface 11 extending axially inwardly from bearing surface 10 and an annular sealing surface 12 extending radially inwardly from conical sealing surface 11 to gas passage 13. As shown in FIG. 2, the first end, i.e. the lower end, of tube 14 extends into the second end, i.e. the upper end, of tube 16 with end surface 1 facing annular sealing surface 12, with conical surface 11 facing the conical sealing surface defining projection 3, with annular sealing surface 2 facing bearing surface 10, and with the lower portion of the periphery 36 facing axial surface or surfaces 9. As will be apparent, this arrangement provides a labyrinth seal 6, thereby providing an effective seal between the interior and the exterior of the axially connected tubes.

As shown in FIG. 2, the surfaces 2 and 10 may be in direct contact, or alternatively there may be provided therebetween a ceramic mastic or putty material. Furthermore, the gaps between surfaces 1 and 12, between surface 11 and the surface defining projection 3, and between surfaces 9 and, 36 may be filled with a ceramic mastic or putty material, 15 and 17 respectively, to define sealants. Those skilled in the art readily would understand what conventional ceramic mastic or putty materials could be employed for this purpose.

Figure 3:
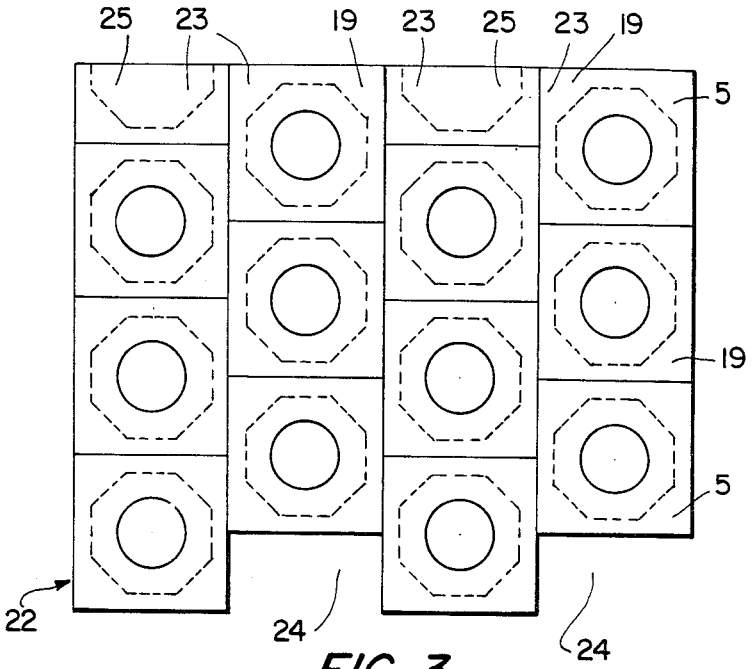
FIG. 3 is a top plan view of a tier of recuperator tubes arranged according to the invention.
Figure 5A:
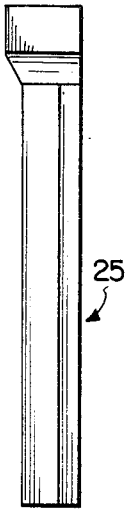
FIGS. 5A and 5B are an elevation view and a top plan view, respectively, of a modified filler element in the form of a partial tube according to the present invention.
Figure 5B:
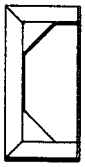

FIG. 3 illustrates a top plan view of a tier 22 of tubes 19 arranged in parallel rows 23 of tubes. As shown, in a preferable arrangement the tubes of adjacent rows 23 are staggered longitudinally of the rows, thereby defining gaps 24 at the ends of alternate of the rows. Fill members 25, illustrated more clearly in FIGS. 5A, 5B and in the shape of partial tubes, fill gaps 24. Fill members 25 may be fabricated as solid members, or alternatively may be formed as half of a tube 14, with the half portion of the gas passage therethrough being filled with a refractory material.

Figure 4:
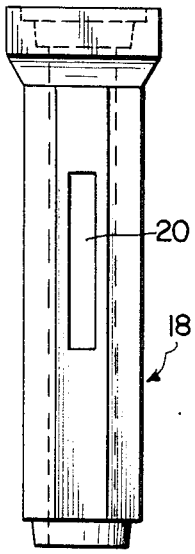
FIG. 4 is an elevation view of a modified recuperator tube according to the present invention.

FIG. 4 illustrates a tube 18 which is of the same construction as tube 14, with the exception that there is provided through the wall thereof a rectangular opening 20 extending from gas passage 13 to the periphery 36. The function of tube 18 will be described in more detail below with reference to FIG. 9.

Figure 6A:
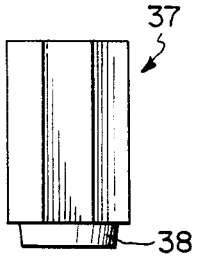
FIGS. 6A and 6B are an elevation view and a bottom plan view, respectively, of a modified recuperator tube according to the present invention.
Figure 6B:
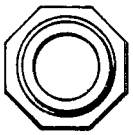

Furthermore, FIGS. 6A and 6B illustrate the configuration of a shortened ceramic recuperator tube 37 employed as the tubes forming an uppermost tier of tubes in a recuperator, to be described in more detail below with reference to FIG. 7. Each shortened tube 37 has projecting from the lower end thereof a projection 38 similar to that of projection 3 of tube 14.

Figure 7:
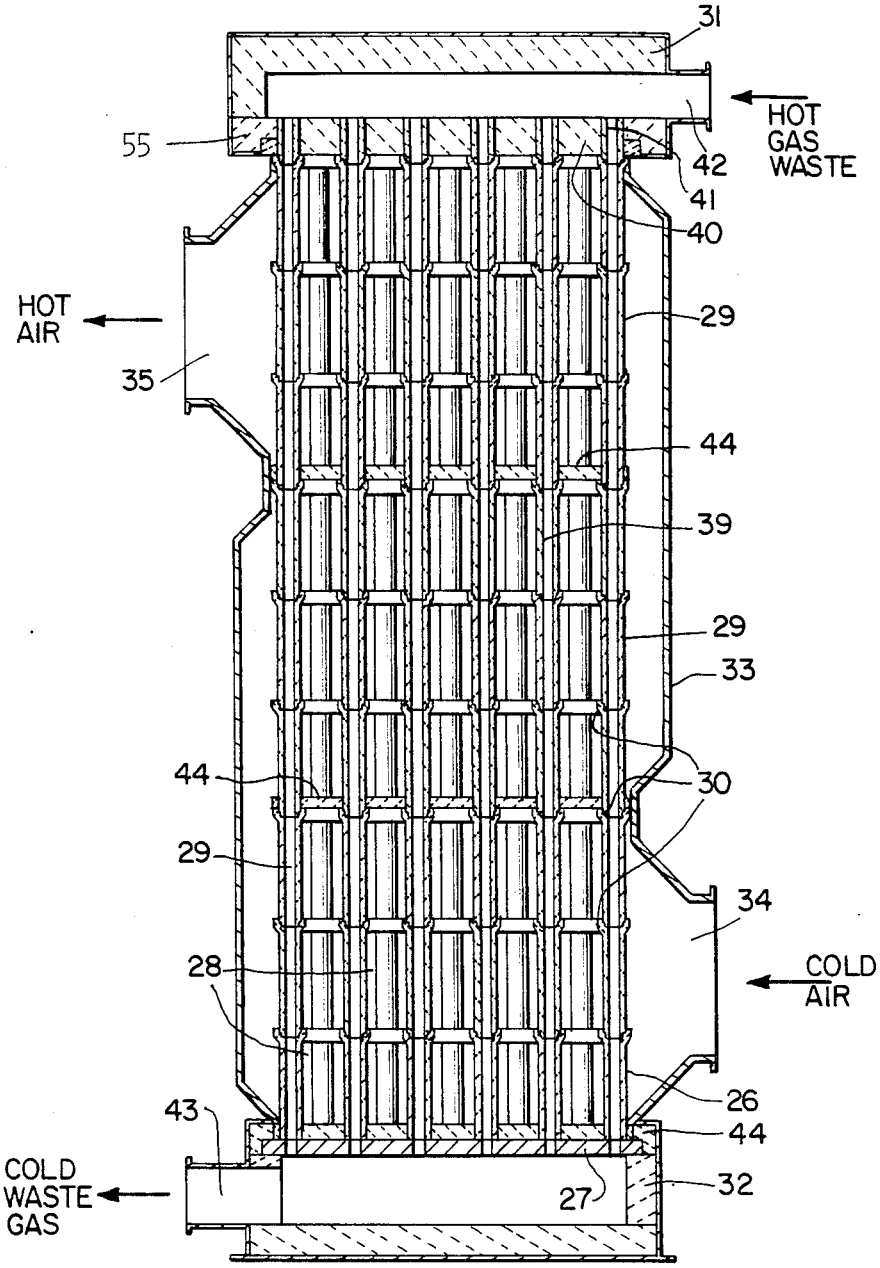
FIG. 7 is a somewhat schematic elevational cross sectional view of a recuperator according to the present invention.
Figure 8:
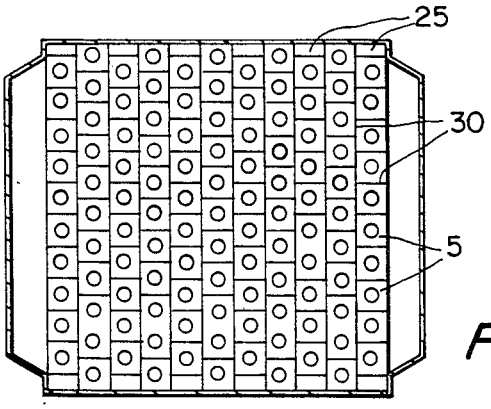
FIG. 8 is a cross sectional view of the recuperator of FIG. 7.

With reference now to FIGS. 7 and 8, there is illustrated a recuperator 7 in accordance with the present invention and including a casing 33, for example formed of a metal material, having an inlet opening 34 for the receipt of a gaseous medium to be heated, for example cold air, and also having extending therefrom an outlet opening 35 for the discharge of the heated gaseous medium, for example hot air. A bundle 39 of tubes is housed within the casing 33 and is in the form of a plurality of tiers 29 of tubes, formed as described with reference to FIG. 3. Casing 33 is closed at the top with a removable flue gas inlet hood 31 and at the bottom with a collecting chamber 32. Hood 31 is provided with a hot waste gas inlet 42, and chamber 32 is provided with a cold waste gas outlet 43.

The tubes of the lowermost tier 26 are mounted on a perforated plate 27 formed of a steel or cast iron material, and the gas passages through such tubes communicate with the perforations through plate 27. To seal the plate 27, the top of such plate is provided with a refractory layer 44, of a material which will be apparent to those skilled in the art. This layer also protects perforated plate 27 from the effects of the hot waste gases. Additionally, the empty space 28 surrounding the tier 26 of tubes may be filled with a refractory mastic or putty material, at least the lower portion of such space.

The joints (FIG. 8) at the points of contact of the flanges 5 of the tubes of each tier are sealed with felt strips 30 (shown as lines only due to considerations of scale) having a thickness of, for example, 4 mm and formed of a temperature resistant fiber material. Such felt strips are bonded on one side and are compressed to about 2 mm during installation. These felt strips accommodate horizontal thermal expansion of the flanges 5 during use of the recuperator.

Vertical expansion of the tubes of the bundle 39 proceeds from the insulated steel plate upwardly to the top in a soft packing of temperature resistant fiber material which is held in place by refractory bricks 55. The uppermost tier 41 of tubes of the bundle 39 is formed of tubes 37 shown in FIGS. 6A, 6B. Thus, this tier of tubes is not provided with flanges 5, and there are spaces between adjacent of the tubes at the top thereof.

The hot flue gases are introduced through gas inlet opening 42 into the flue gas inlet hood 31 and from there pass through the vertically aligned and connected gas passages 13 of the tubes of the tiers. Inlet hood 31 is lined with a refractory material as illustrated schematically. The hot flue gases flow through the tubes in a downward direction, during which heat is transferred from the flue gases to the gaseous medium being heated, for example air. The tubes assembled in accordance with the present invention define smooth walled round gas passages 13 that easily can be cleared of deposits with appropriate tools. Cooled flue gases are conducted to collecting chamber 32, also lined with a refractory material, and are exhausted through the gas outlet opening 43. The gaseous medium to be heated, for example air, is introduced through inlet 34 and passes between the adjacent exterior surfaces of the tier of the tubes. In other words, the gases will pass between the spaces defined between the peripheries shown by dashed lines in FIG. 3. This passing will be in a generally horizontal direction across the exterior of the tubes. The exteriors of the tiers of tubes are vertically connected, such that the air being heated generally passes in a serpentine manner from the bottom to the top of the recuperator, with the hot air being discharged at outlet 35.

Refractory layers 44 are provided at predetermined intervals, as illustrated. Refractory layers 44 thus provide a lateral stabilization of the bundle of tubes. Refractory layers 44 further provide a secondary seal to prevent contamination of the air being heated by the waste gases. Refractory layers 44 further provide a definition of a generally upward serpentine flow of the air being heating, as will be apparent from a consideration of FIG. 7.

To clean the tube bundle 39, the hood 31 and the chamber 32 may be removed, whereby it will be apparent that the gas passages 13 through the aligned and communicated tubes easily may be cleaned by appropriate tools.

Figure 9:
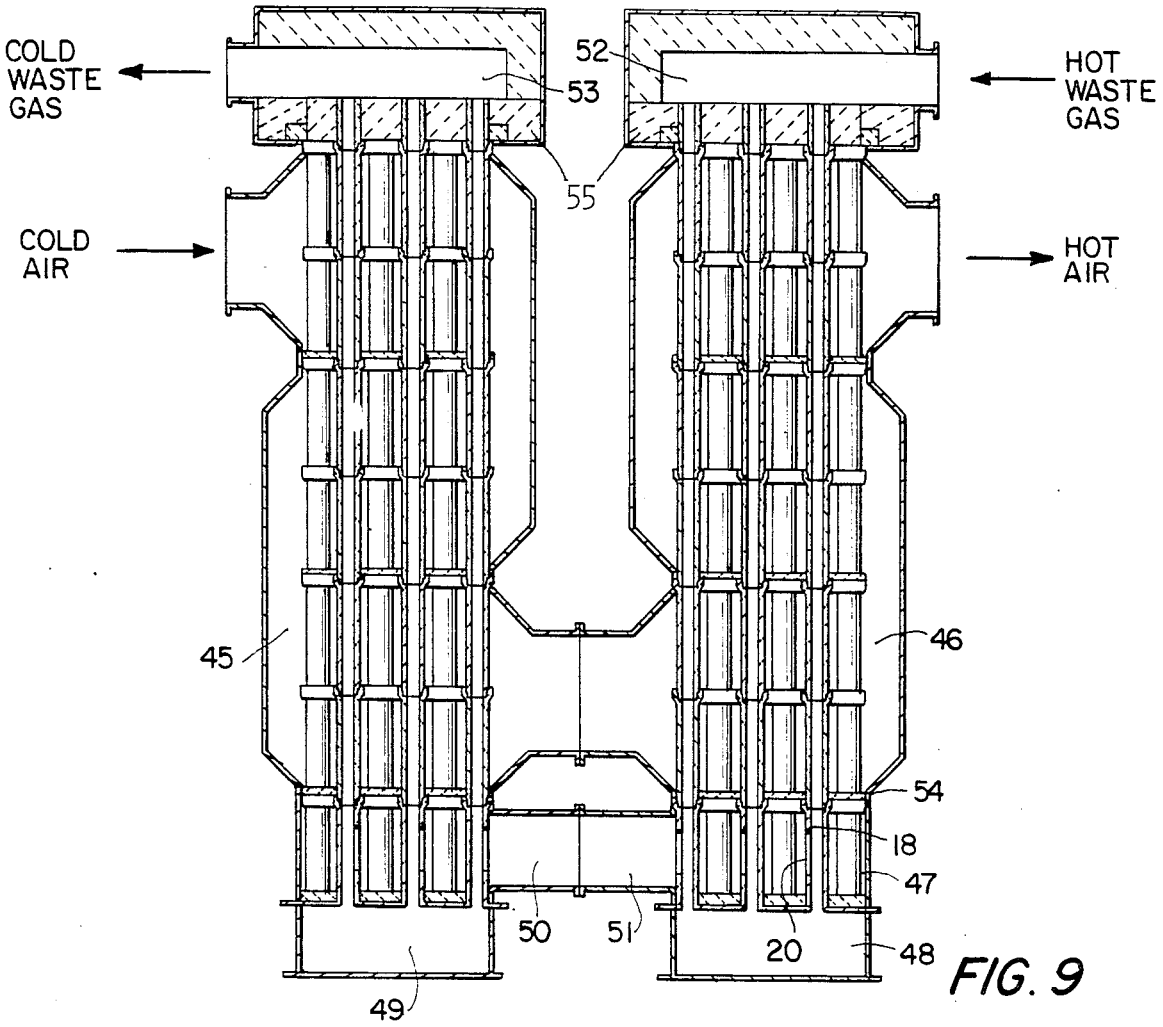
FIG. 9 is a somewhat schematic elevational cross sectional view of a modified recuperator according to the present invention.
Figure 10:
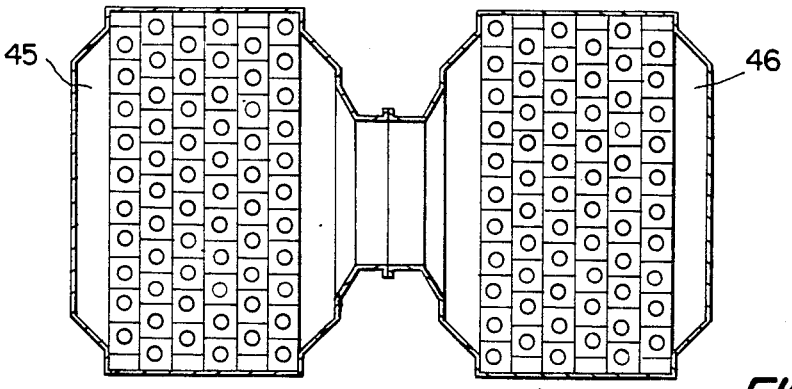
FIG. 10 is a cross sectional view of the recuperator of FIG. 9.

FIGS. 9 and 10 illustrate another embodiment of the recuperator according to the present invention. This recuperator structure particularly is useful in an installation where the vertical height of the available space is insufficient to accommodate the recuperator of FIG. 7. In such situation, the recuperator is divided into two halves 45, 46 which are placed laterally adjacent each other. The divided recuperator illustrated in FIG. 9 includes basically the same design features as the recuperator of FIG. 7. However, in the less hot recuperator part 45, the cold air entry is at the top and the cold air discharge is at the bottom.

The lowermost tier 47 of tubes of both recuperator parts 45, 46 is in the form of a tier of tubes 18 constructed according to FIG. 4, i.e. having therethrough lateral windows 20. Thus, the vertical flow of waste gas in part 46 will be downwardly through gas passages 13, laterally outwardly through openings 20, through connecting passages 51, 50, through openings 20 and into the interior of gas passages 13 of recuperator part 45, and then upwardly. The waste gas is introduced to the recuperator part 46 at inlet hood 52 and is discharged from gas outlet hood 53 of recuperator part 45. The air being heated is transferred from recuperator part 45 to recuperator part 46 by the horizontal connection illustrated. A refractory layer 54 is provided above the lowermost tier 47 in each recuperator part to prevent contamination of the air being heated by the waste gases. Collecting chambers 48, 49 collect any solid contaminants released from the waste gases.

In the illustrated arrangements, the waste gases flow counter to the direction of movement of the gaseous medium being heated. However, the recuperator of the present invention may be designed to achieve a crossflow/counterflow, or only a crossflow.

Although the present invention has been described and illustrated with respect to preferred features thereof, it is to be understood that various modifications and changes may be made to the specifically described and illustrated features without departing from the scope of the present invention.

We claim:

1. In a recuperator of the type including plural ceramic recuperator tubes arranged vertically on top of each other, each said tube having an outer periphery, first and second opposite ends and a gas passage extending longitudinally between said ends, the improvement wherein:

said first end includes an annular sealing surface extending radially inwardly from said periphery, and an annular projection defined by a conical surface extending axially from said sealing surface to an end surface of said first end;

said second end includes a square flange extending outwardly from said periphery and defined by four entirely planar flange side walls, and a stepped seal extending axially inwardly into said flange from an end surface of said second end, said stepped seal comprising axially outer and inner steps, said outer step comprising at least one axial surface extending inwardly from said end surface of said second end and a ground annular bearing surface extending radially inwardly from said axial surface, and said inner step comprising an annular conical sealing surface extending axially inwardly from said bearing surface and an annular sealing surface extending radially inwardly from said conical sealing surface to said gas passage;

said outer periphery is uniform from said flange at said second end to said annular sealing surface at said first end; and said projection and said sealing surface of said first end of one said tube extend into and seal with said stepped seal of said second end of another said tube with said end surface of said first end facing said annular sealing surface of said second end, with said conical surface of said first end facing said conical sealing surface of said second end, with said annular sealing surface of said first end facing said bearing surface of said second end, and with said periphery of said first tube facing said axial surface of said second end.

2. The improvement claimed in claim 1, further comprising ceramic mastic between respective said facing surfaces.

3. The improvement claimed in claim 1, wherein said annular sealing surface of said first end directly contacts said bearing surface of said second end, and further comprising ceramic mastic between the other respective said facing surfaces.

4. The improvement claimed in claim 1, wherein said gas passage has a circular cross section and is defined by a cylindrical surface.

5. The improvement claimed in claim 1, wherein said periphery has a circular cross section defined by a cylindrical surface.

6. The improvement claimed in claim 1, wherein said periphery has a polygonal cross section.

7. The improvement claimed in claim 6, wherein said cross section is octagonal.

8. The improvement claimed in claim 1, wherein said tubes are formed of a SiC material.

9. The improvement claimed in claim 1, wherein certain of said tubes each have formed therein a rectangular opening extending from said gas passage to said periphery.

10. The improvement claimed in claim 1, wherein said tubes are arranged in vertically spaced tiers of tubes, each said tier comprising parallel rows of tubes.

11. The improvement claimed in claim 10, wherein the tubes of adjacent said rows are staggered longitudinally of said rows, thereby defining gaps at ends of alternate said rows, and further comprising fill members in the shape of partial tubes and filling said gaps.

12. The improvement claimed in claim 10, wherein said tubes of the lowermost said tier are mounted on a perforated plate.

13. The improvement claimed in claim 12, wherein said gas passages of said tubes communicate with perforations in said plate.

14. The improvement claimed in claim 10, wherein a space surrounding a lower portion of said tier of tubes adjacent the next lower tier of tubes is filled with a refractory putty.

15. The improvement claimed in claim 10, wherein said flanges of said tubes of each said tier are in abutment with sealing felt strips therebetween.

16. The improvement claimed in claim 10, wherein said tiers of tubes are arranged within a casing having inlet and outlet openings for circulating through said casing exteriorly of said tubes a gas to be heated, and further comprising flue gas inlet and outlet hoods connected to said casing for supplying flue gas into first ends of said gas passages and for discharging said flue gas from second ends of said gas passages.

17. A ceramic recuperator tube for use in a recuperator of the type including plural said ceramic tubes arranged vertically on top of each other, said tube comprising:

an outer periphery, first and second opposite ends and a gas passage extending longitudinally between said ends;

said first end including an annular sealing surface extending radially inwardly from said periphery, and an annular projection defined by a conical surface extending axially from said sealing surface to an end surface of said first end;

said second end including a square flange extending outwardly from said periphery and defined by four entirely planar flange side walls, and a stepped seal extending axially inwardly into said flange from an end surface of said second end, said stepped seal comprising axially outer and inner steps, said outer step comprising at least one axial surface extending inwardly from said end surface of said second end and a ground annular bearing surface extending radially inwardly from said axial surface, and said inner step comprising an annular conical sealing surface extending axially inwardly from said bearing surface and an annular sealing surface extending radially inwardly from said conical surface to said gas passage; and said outer periphery being uniform from said flange at said second end to said annular sealing surface at said first end;

whereby said projection and said sealing surface of said first end of said tube are adapted to extend into and seal with a stepped seal of a second end of another said tube.

18. A tube as claimed in claim 17, wherein said gas passage has a circular cross section and is defined by a cylindrical surface.

19. A tube as claimed in claim 17, wherein said periphery has a circular cross section defined by a cylindrical surface.

20. A tube as claimed in claim 17, wherein said periphery has a polygonal cross section.

21. A tube as claimed in claim 20, wherein said cross section is octagonal.

22. A tube as claimed in claim 17, wherein said tube is formed of a SiC material.

* * * * *